US005983696A

United States Patent [19]

Maher

[11] Patent Number: 5,983,696

[45] Date of Patent: Nov. 16, 1999

[54] TRANSFER SYSTEM

[75] Inventor: John H. Maher, 532 S. Saginaw, Flint, Mich. 48502

[73] Assignee: John H. Maher; as Trustee Under a Trust Agreement of John Maher dated Feb. 6, 1998

[21] Appl. No.: 09/035,935

[22] Filed: Mar. 2, 1998

[51] Int. Cl.[6] ..... B21D 43/05

[52] U.S. Cl. ..... 72/405.16; 72/405.13; 72/421; 198/621.2

[58] Field of Search ..... 72/405.16, 405.13, 72/405.01, 421; 198/621.1–621.4

[56] References Cited

U.S. PATENT DOCUMENTS

| | | | |
|---|---|---|---|
| 4,875,931 | 10/1989 | Monteiro | 72/421 |
| 5,105,647 | 4/1992 | Maher | 72/405 |
| 5,346,055 | 9/1994 | Zierpka | 72/405.13 |
| 5,363,685 | 11/1994 | Luthi | 72/405.13 |
| 5,582,061 | 12/1996 | Harsch et al. | 72/405.1 |
| 5,617,756 | 4/1997 | Thudium | 72/405.16 |
| 5,779,025 | 7/1998 | Dangelmayr | 198/621.1 |

FOREIGN PATENT DOCUMENTS

| | | | |
|---|---|---|---|
| 3151950 | 7/1983 | Germany | 72/405.01 |

*Primary Examiner*—Daniel C. Crane
*Attorney, Agent, or Firm*—Gifford, Krass, Groh, Sprinkle, Anderson & Citkowski, P.C.

[57] ABSTRACT

A transfer system for moving work pieces held in workpiece grippers along a first, horizontal axis between a plurality of spaced apart workstations, the transfer system including a press having a ram moveable along a second, vertical axis and a bolster aligned with and positioned below the ram. The workpiece grippers are mechanically connected to a transfer rail which extends along the first, longitudinal axis, the transfer rail being supported for movement along the second, vertical axis between a raised and lowered position and along a third, horizontal axis, normal to the first, longitudinal axis, between a forward position and a retracted position. The improvement of the present invention comprises biasing means for urging the transfer rail toward its raised and forward position and movement means connected to the ram for exerting a force on the transfer rail to overcome the biasing means and urge the transfer rail toward its lowered and retracted position.

17 Claims, 3 Drawing Sheets

Second, Vertical Axis
Third, Horizontal Axis

TRANSFER SYSTEM

FIELD OF THE INVENTION

The present invention relates generally to transfer systems for transferring work pieces between workstations utilizing a transfer rail, and more particularly to a system wherein the vertical and horizontal movement of the transfer rail is caused by vertical movement of the ram.

BACKGROUND OF THE INVENTION

Complex transfer systems are frequently utilized in industries such as the metalworking industry to transfer work pieces through a series of linearly aligned, spaced apart workstations such as are present in a transfer press. At each workstation, an operation such as stamping is performed on the work piece. As the transfer system moves the work piece through the workstations of the press, a sequence of operations is performed upon the work pieces.

Each press includes a ram positioned above a bolster. At each workstation in the press, an upper die half is affixed to the ram and a lower die half is affixed to the bolster. The die halves are aligned so that, as the ram moves downward, the die halves perform a stamping or other operation on the work piece positioned between the die halves.

To move work pieces successively through the workstations, the work pieces must be moved along a first longitudinal axis, a second, vertical axis and a third, horizontal axis, extending laterally to the longitudinal axis. My U.S. Pat. No. 5,105,647 discloses a transfer system in which a transfer rail extending along the first, longitudinal axis and spaced apart from the press, is supported for movement along the second, vertical axis between a raised and lowered position. The transfer rail is also supported for movement along the third, horizontal axis between a forward position proximate to the press and a retracted position. A finger rail is slidably mounted to the transfer rail so that the finger rail is moveable along the first, longitudinal axis. The work pieces are gripped by work piece grippers which are mounted to the finger rail. As the finger rail moves longitudinally with respect to the transfer rail, the work pieces held by the grippers may be positioned at various points along the first, longitudinal axis. As the transfer rail moves along the second, vertical axis and along the third, horizontal axis, the work pieces may be raised or lowered and placed proximate to or retracted from the press.

My patent further discloses a system for transferring work pieces through a series of workstations wherein independently supported actuator units such as a dual axis hydraulic actuator are provided which have a lateral arm to support the transfer rail and to impart up and down and back and forth movement to it. Individually controllable means are provided for imparting reciprocal linear motion to the finger rail along the direction of travel of the work pieces as they pass through the workstations. Means are provided for centrally controlling the movement of the transfer rail and finger operator rail to synchronize travel of the work pieces through the successive workstations in timed relation with performance of the sequence of operations. The central control system coordinates the large number of complicated transfers and multiple realignments.

SUMMARY OF THE INVENTION

The present invention provides a transfer system of this general type wherein movement of the transfer rail to which at least one workpiece gripper is mechanically connected is accomplished by simplified movement of the transfer rail and finger rail which do not require independent actuators.

The improvement of the present invention comprises biasing means for urging the transfer rail toward its raised and forward positions and movement means connected to the ram for exerting a force on the transfer rail to overcome the aforementioned biasing means and urge the transfer rail toward its lowered and retracted position.

In the preferred embodiment, such biasing means urge the transfer rail toward its forward and raised position. Preferably, forward biasing means comprise at least one transfer rail support rod extending along the third, horizontal axis. The support rod preferably has a first end in mechanical communication with the transfer rail and a second end in mechanical communication with a support rod cylinder. Each support rod cylinder is compressible along the third, horizontal axis. Means are provided for actuating each support rod cylinder so that, as the cylinder is actuated, the support rod and transfer rail move along the third, horizontal axis.

In the preferred embodiment, the movement means includes means for lowering the transfer rail and means for retracting the transfer rail. Preferably, the means for lowering and the means for biasing the transfer rail toward its raised position are unified in a single assembly comprising at least one upper cylinder. Each upper cylinder is compressible along the second, vertical axis and is mounted to the ram.

The upper cylinders are disposed between an upper plate and the ram. The upper plate is supported by at least one and preferably four upper plate support cylinders, each upper plate support cylinder being compressible along the second vertical axis. The upper plate support cylinders are mounted on a lower plate positioned below the upper plate. The ram, the upper plate and the lower plate are aligned along the second, vertical axis.

The lower plate is mounted on at least one lower plate support cylinder, each such cylinder being compressible along the second, vertical axis. Support means are provided which extend between the lower plate and the transfer rail, such support means fixing the relative positions of the lower plate and transfer rail so that the lower plate and the transfer rail are spaced apart from the ram by the same distance as the lower plate and the transfer rail move along the second, vertical axis. In the preferred embodiment, such support means includes the plurality of support rods previously discussed which act to bias the transfer rail toward its forward position. Thus, as the ram moves linearly downwardly along the second, vertical axis, the ram compresses the upper cylinder, the upper plate support cylinders, and the lower plate support cylinders thereby moving the upper plate, the lower plate and the transfer rail downward along the second, vertical axis.

In the preferred embodiment, the upper cylinder, the upper plate support cylinders and the lower plate support cylinders are configured to bias the transfer rail toward its raised position.

In the preferred embodiment, the retracting means for moving the transfer rail toward its retracted position along the third, horizontal axis comprises a channel and a flexible elongated strap having a first end attached to a stationary member and a second end mechanically connected to the transfer rail and the workpiece grippers, the flexible elongated strap passing over the channel. A projecting member is mounted to the ram and projects downwardly along the second, vertical axis. The member is aligned with the channel so that the flexible strap is disposed between the channel and the projecting member. As the projecting member and ram move linearly downwardly along the second, vertical axis, the projecting member contacts the flexible strap, moving the strap into the channel, and drawing the workpiece grippers toward their retracted position.

Other objects advantages and applications of the present invention will be made clear by the following detailed description of a preferred embodiment of the invention. The description makes references to drawings in which:

DETAILED DESCRIPTION OF THE INVENTION

Figure 1:
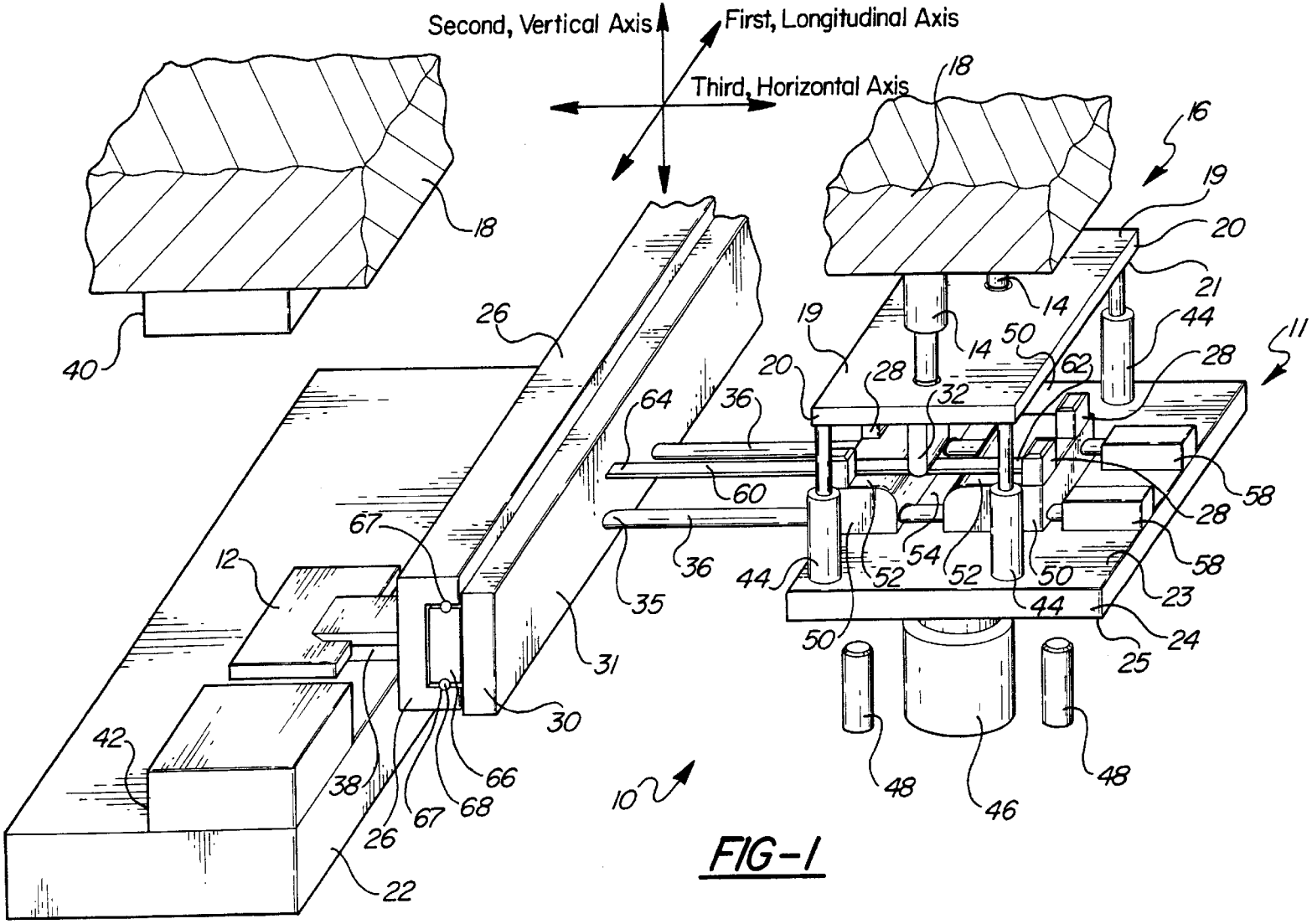
FIG. 1 is a perspective view of the system of the present invention.

Referring to FIG. 1, a transfer system 10 is shown therein for moving work pieces 12 between work stations positioned along a first, longitudinal axis. To accomplish such movement, the work pieces 12 are held in workpiece grippers 38 and are moved along three axes; a first, longitudinal axis, a second, vertical axis which is perpendicular to the first, longitudinal axis and a third, horizontal axis which is perpendicular to both the second, vertical axis and the first, longitudinal axis. A press 16, partially depicted in FIG. 1, includes a ram 18. For purposes of clarity, the ram 18 has been shown in sections. The press 16 moves the ram 18 along the second, vertical axis. As shown at the left in FIG. 1, an upper die half 40 is attached to ram 18.

A lower die half 42 is supported on a bolster 22, the upper die half 40 and the lower die half 42 being aligned so that, as the ram 18 is lowered, the upper die half impacts the work piece 12 positioned between the upper die half 40 and the lower die half 42. A plurality of such dies may be utilized, each die being variously configured and positioned in one of the work stations along the first, longitudinal axis.

As shown in FIG. 1, the work piece 12 is held by work piece grippers 38 which are mechanically connected to the transfer rail 30 and are preferably mounted to a finger rail 26. The finger rail 26 is preferably mounted to the transfer rail 30 via bearings 68 to a raceway 67 of a flange 66 of the transfer rail 30. The transfer rail 30, having a rearward side 31, is movable along the second, vertical axis and along the third, horizontal axis. The finger rail 26 may be moved along the first, longitudinal axis by a variety of means and, in a preferred embodiment, is moved along the first, longitudinal axis by a linkage which is mechanically connected to the ram 18.

The transfer rail 30 and workpiece grippers 38 are movable between a raised position and a lowered position along the second, vertical axis. The transfer rail and workpiece grippers 38 are also movable between a forward position and a retracted position along the third, horizontal axis. In the preferred embodiment, the transfer rail 30 and workpiece grippers 38 are biased towards their raised and forward positions.

As shown at the right in FIG. 1, an assembly 11 is provided for biasing the transfer rail toward its raised and forward position and for overcoming such bias and moving the transfer rail 30 toward their lowered and retracted positions. Although these movements of the transfer rail 30 and workpiece grippers 38 may, in alternate embodiments, be performed by separate and distinct assemblies, in the preferred embodiment such functions are combined into the assembly 11 as depicted in FIG. 1.

In the preferred embodiment, the assembly 11 includes at least one upper cylinder 14 which is in mechanical communication with ram 18. Preferably, at least two cylinders 14 are provided and each cylinder 14 is mounted to the ram 18. Each upper cylinder 14 is compressible along the second, vertical axis and, in the preferred embodiment, is a nitrogen cylinder.

The upper cylinders 14 are disposed between the ram 18 and an upper plate 20 having an upper surface 19 and a lower surface 21. The upper plate 20 is preferably supported by four upper plate support cylinders 44. Each upper plate support cylinder 44 is compressible along the second, vertical axis. In the preferred embodiment, the upper plate support cylinders 44 are attached to an upper surface 23 of a lower plate 24 and to the lower surface 21 of the upper plate 20.

A lower plate cylinder 46 is positioned beneath the lower plate 24, such cylinder 46 supporting the lower plate 24. A plurality of such lower plate support cylinders 46 are preferably provided, although only one cylinder 46 is shown for clarity in FIG. 1. The lower plate cylinder 46 is compressible along the second, vertical axis. Preferably, the cylinders 44 and 46 are configured so that each cylinder urges its respective plate 20 and 24 upwardly. In particular, each lower plate support cylinder 46 is configured to urge the lower plate 24 upward along the second, vertical axis. Likewise, the upper plate support cylinders 44 are each configured to urge the upper plate 20 upward along the second, vertical axis.

At least one rigid transfer rail support rod 36 is provided, each rod 36 having a first end 35 mechanically connected to the rearward surface 31 of the transfer rail 30. Each transfer rail support rod 36 has a second end 37 which is in mechanical communication with support rod cylinder assembly 58. Preferably, the cylinder assembly 58 urges support rod 36, transfer rail 30 and workpiece grippers 38 forward. Each support rod 36 preferably passes through and is supported by a platform 50. Thus, the transfer rail 30 is maintained in a fixed relationship with respect to the lower plate 24 for movement along the second, vertical axis such that the transfer rail 30 and the lower plate 24 move as a unit along the second, vertical axis.

The cylinders 14, 44 and 46 preferably are configured to compress under different loads so that, as the ram applies a compressive force to the assembly 11, the lower plate support cylinder 46 compresses first, the upper plate support cylinders 44 are compressed next, and cylinders 14 are compressed last. A projecting member 32 projects downwardly from the lower surface 21 of upper plate 20. A channel 54, formed by a plurality of platforms 50 positioned on the upper surface 23 of lower plate 24, is positioned below and aligned with the downwardly projecting member 32. A flexible elongated strap 60 having a first end 62 attached to a stationary member such as platform 50 or upper plate stops 28, and a forward end 64 which is mechanically connected to the workpiece grippers 38 and preferably is attached to the rearward surface 31 of the transfer rail 30. Preferably, strap 60 is thin and flexible and is comprised of rubber, metal, a chain or the like.

The support rod cylinder assembly 58 includes an actuating motor and a cylinder which permits the support rods 36 to be retracted and extended along the third, horizontal axis. In the preferred embodiment depicted in FIG. 1, the support rods 36 pass through the platforms 50 and are preferably encased in bushings such as bronze bushings. In the preferred embodiment, two or more transfer rail support rods are utilized.

Figures 2, 3, 4, 5, 6, 7:
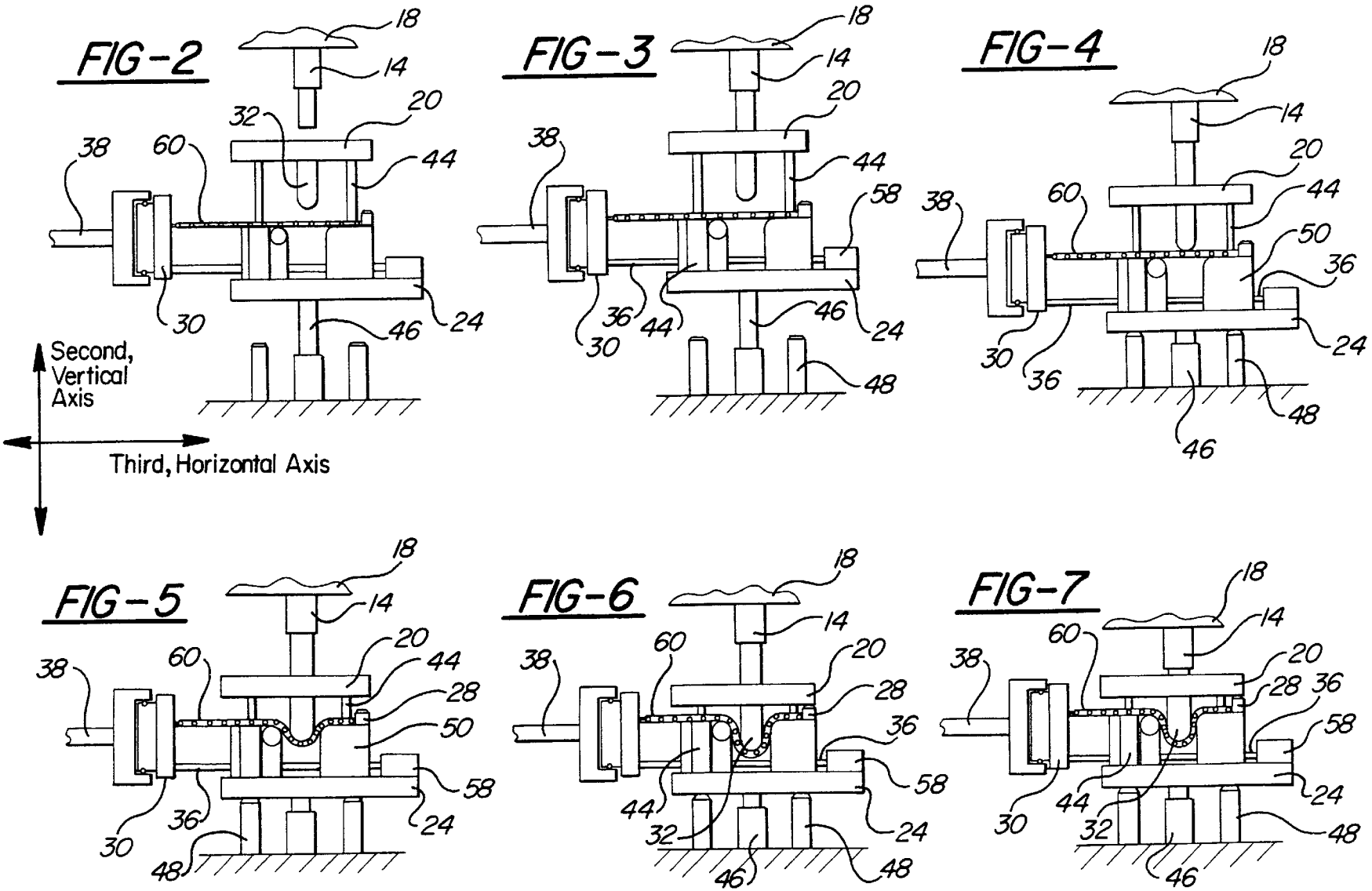
FIGS. 2 through 7 are sequential side views of the present invention showing the progressive positions of the workpiece grippers, transfer rail, cylinders and plates as the ram is lowered from an upper point in the stroke of the ram, depicted in FIG. 2, to a point where the ram is at its lowest point in its downward stroke, depicted in FIG. 7

The sequential movement of the transfer rail and the workpiece grippers along the second, vertical axis and along the third, horizontal axis is depicted in FIGS. 2–7. As shown in FIG. 2, ram 18 is in a raised position along the second, vertical axis so that upper cylinder 14 is not in contact with the upper plate 20. The lower plate support cylinder 46 has urged the lower plate 24 upward, and the upper plate support cylinders 44 have urged upper plate 20 upward along the second, vertical axis. The projecting member 32 is in a raised position and does not contact the flexible elongated strap 60.

As shown in FIG. 3, the ram 18 has moved downwardly along the second, vertical axis until the upper cylinder 14 has contacted the upper plate 20. As lower plate 24 is moved downward, the support rods 36 and support rod cylinder assemblies 58 are moved downward, thus moving the transfer rail 30 and workpiece grippers 38 downwardly toward their lowered position. As shown in FIG. 4, ram 18 has continued its downward motion along the second, vertical axis and has compressed the lower plate support cylinder 46 until the lower plate 24 rests on stops 48. The height of stops 48 may be easily altered and are preferably placed and configured to provide substantial support to lower plate 24. The downwardly projecting member 32 is brought into contact with the flexible strap 60.

As shown in FIG. 5, the ram 18 has continued its downward motion and the upper plate support cylinders 44 are being compressed, thus moving the upper plate 20 toward its lowered position and causing the projecting member 32 to move strap 60 into the channel 54. As strap 60 moves downward into channel 54, the retracting force applied to the transfer rail 30 overcomes the bias of the support rods 36 and retracts the transfer rail 30 and the workpiece gripper 38 along the third, horizontal axis.

As shown in FIGS. 6 and 7, the ram continues its downward motion until the projecting member 32 has completed its travel along the second, vertical direction when the cylinders 44 are completely compressed and upper plate 20 rests against the upper plate stops 28. Thus, the transfer rail 30 and workpiece gripper 38 have been moved to their retracted position by the linear motion of the ram downward along the second, vertical axis. The projecting member 32, the elongated strap 60, the support rods 36 and support rod cylinder assemblies 58 may be variously configured to move the transfer rail 30 and the workpiece grippers 38 along the third, horizontal axis at any of a variety of times in the stroke of the ram 18.

By utilizing a plurality of cylinders having different compressibilities positioned between a pair of parallel plates, the transfer rail 30 and workpiece grippers 38 have been moved from a raised position to a lowered position along the second, vertical axis while the ram 18 completes its downward stroke. The compressibilities of the cylinders, the plate widths and heights of stops 48 and 28 of the present invention may be altered to provide a wide variety of timed movements of the transfer rail 30 and workpiece grippers 38. For example, if it is desired that the transfer rail 30 and workpiece grippers 38 be moved downward when the ram 18 is near the bottom of its stroke, cylinder 14 may compress first, followed by cylinders 44 and lastly by cylinder 46.

As the ram 18 moves upward, the elements of the present invention move from the position depicted in FIG. 7 to the position depicted in FIG. 2. The length of the cylinders, height of the stops, strap length, depth of the channel, length of the downwardly projecting member and cylinder compressibilities, as well as other parameters of the present invention, may be easily altered to provide for an alternate timed movement pattern of the workpiece grippers 38.

Figure 8:
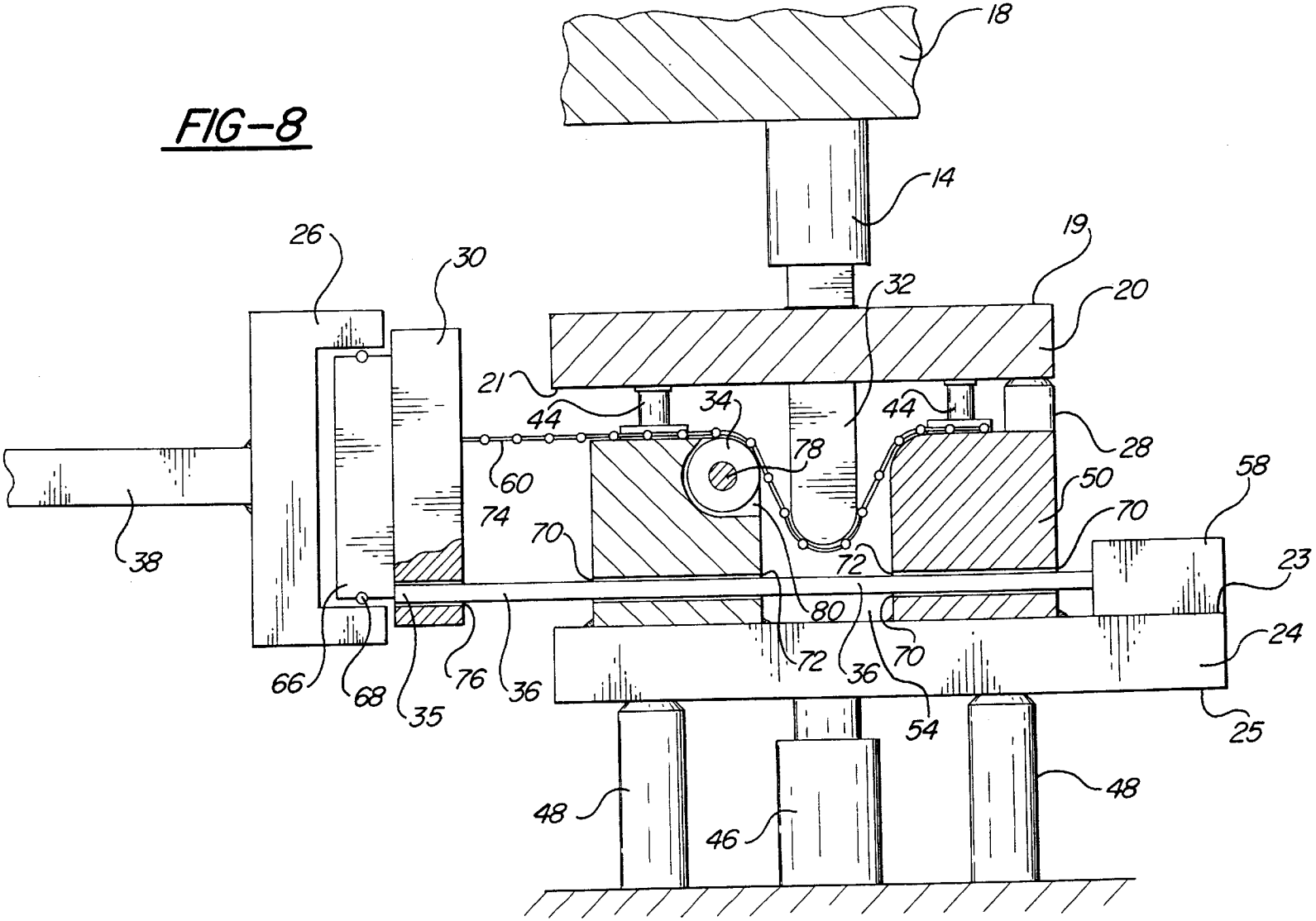
FIG. 8 is a side view of an alternate embodiment of the system of the present invention.

A partial cross-sectional view of an alternate embodiment of the invention is shown in FIG. 8, and depicts the first end 35 of transfer rail support rod 36 engaging a support rod bushing 76 embedded in a support rod aperture 74. The support rod 36 also passes through apertures 70 in platforms 50 wherein bushings 72 have been embedded, the support rods 36 passing through such bushings. The embodiment depicted in FIG. 8 shows a rotating member 34 mounted along an axis 78 to the platform 50. An aperture 80 is provided so that the rotating member 34 is free to rotate and assist flexible strap 60 in its descent into the channel 54.

Additional shock absorbers may be provided to reduce undesired acceleration and movement of the transfer rail and/or workpiece grippers in any direction. A controller, sensors and simple adjusting motors may also be provided to permit coordination and adjustment of the various elements of the present invention.

Thus, the present invention accomplishes vertical and horizontal movement of the transfer rail 30 and workpiece grippers 38 without complex motors, cams or other complicated systems while providing a high degree of flexibility, thereby permitting a single transfer system to be utilized in a variety of manufacturing systems.

Having described the various embodiments of the present invention with reference to the accompanying figures, it will be appreciated that various changes and modifications can be made without departing from the scope or spirit of the invention.

I claim:

1. In a transfer system for moving work pieces along a first, longitudinal axis between a plurality of spaced apart workstations, the transfer system including a press having a ram moveable along a second, vertical axis, a bolster aligned with and positioned below the ram, and a transfer rail extending along the first, longitudinal axis, the transfer rail being supported for movement along the second, vertical axis between a raised and lowered position and along a third, horizontal axis, normal to the first, longitudinal axis and the second, vertical axis, between a forward position and a retracted position, at least one workpiece gripper mechanically connected to the transfer rail, the improvement comprising:

biasing means for urging the transfer rail toward its raised and forward position; and movement means connected to the ram for exerting a force on the transfer rail to overcome the biasing means and urge the transfer rail towards its lowered and retracted position.

2. The system of claim 1 wherein the movement means includes retracting means for moving the transfer rail toward its retracted position.

3. The system of claim 2 wherein the retracting means includes:

a channel;

a flexible elongated strap having a first end attached to a stationary member and a second end attached to the transfer rail, the flexible elongated strap passing over the channel; and a projecting member attached to the ram and aligned with the channel so that the flexible strap is disposed between the channel and the projecting member;

whereby, as the projecting member and ram move linearly downward along the second, vertical axis, the projecting member contacts the flexible strap and moves the strap into the channel, drawing the transfer rail toward its retracted position.

4. The system of claim 1 wherein the movement means includes lowering means for moving the transfer rail toward its lowered position.

5. The system of claim 4 wherein the lowering means comprises:

at least one upper cylinder, each upper cylinder being compressible along the second, vertical axis and mechanically connected to the ram;

an upper plate, the upper cylinders disposed between the upper plate and the ram;

at least one upper plate support cylinder, each upper plate support cylinder being compressible along the second, vertical axis and mechanically connected to the upper plate;

a lower plate, the upper plate support cylinders disposed between the lower plate and the upper plate;

support means extending between the lower plate and the transfer rail, such means configured so that the lower plate and the transfer rail are each spaced apart from the ram by substantially the same distance as the lower plate and transfer rail move along the second, vertical axis; and at least one lower plate support cylinder, each lower plate support cylinder being compressible along the second, vertical axis and mechanically connected to the lower plate;

whereby, as the ram moves linearly downward along the second, vertical axis, the ram compresses the cylinders, moving the upper plate, the lower plate and the transfer rail downward.

6. The system of claim 5 further comprising at least one lower plate stop positioned below the lower plate.

7. The system of claim 5 further comprising at least one upper plate stop mechanically connected to an upper surface of the lower plate.

8. The system of claim 1 wherein the biasing means includes means for urging the transfer rail toward its forward position.

9. The system of claim 8 wherein the means for urging the transfer rail toward its forward position comprises:

at least one transfer rail support rod having a first end mechanically connected to the transfer rail;

at least one support rod cylinder mechanically connected to a second end of the transfer rail support rod, each cylinder being compressible along the third, horizontal axis; and means for actuating each support rod cylinder so that, as the cylinder is actuated, the support rod and transfer rail move along the third, horizontal axis.

10. In a transfer system for moving workpieces along a first, longitudinal axis between a plurality of spaced apart workstations, the transfer system including a press having a ram moveable along a second, vertical axis, a bolster aligned with and positioned below the ram, and a transfer rail extending along the first, longitudinal axis, the transfer rail being supported for movement along the second, vertical axis between a raised and lowered position, the improvement comprising:

biasing means for urging the transfer rail toward its raised position; and lowering means connected to the ram for exerting a force to urge the transfer rail toward its lowered position.

11. The system of claim 10 wherein the lowering means comprises:

at least one upper cylinder, each upper cylinder being compressible along the second, vertical axis and mechanically connected to the ram;

an upper plate, the upper cylinders disposed between the upper plate and the ram;

at least one upper plate support cylinder, each upper plate support cylinder being compressible along the second, vertical axis and mechanically connected to the upper plate;

a lower plate, the upper plate support cylinders being disposed between the lower plate and the upper plate;

support means extending between the lower plate and the transfer rail, such means configured so that the lower plate and the transfer rail are each spaced apart from the ram by substantially the same distance as the lower plate and transfer rail move along the second, vertical axis; and at least one lower plate support cylinder, each lower plate support cylinder being compressible along the second, vertical axis and mechanically connected to the lower plate;

whereby, as the ram moves linearly downward along the second, vertical axis, the ram compresses the cylinders, moving the upper plate, the lower plate and the transfer rail downward.

12. The system of claim 11 further comprising at least one lower plate stop positioned below the lower plate.

13. The system of claim 11 further comprising at least one upper plate stop in mechanical communication with an upper surface of the lower plate.

14. In a transfer system for moving workpieces along a first, longitudinal axis between a plurality of spaced apart workstations, the transfer system including a press having a ram moveable along a second, vertical axis, a bolster aligned with and positioned below the ram, and a transfer rail extending along the first, longitudinal axis, the transfer rail being supported for movement along a third, horizontal axis, normal to the first, longitudinal axis and the second, vertical axis, between a forward position and a retracted position, the improvement comprising:

biasing means for urging the transfer rail toward its forward position; and retracting means connected to the ram for exerting a force to urge the transfer rail toward its retracted position, the retracting means comprising a channel, a flexible elongated strap having a first end attached to a stationary member and a second end attached to the transfer rail, the flexible elongated strap passing over the channel, and a projecting member attached to the ram and aligned with the channel so that the flexible strap is disposed between the channel and the projecting member so that, as the projecting member and ram move linearly downward, the projecting member contacts the flexible strap and moves the strap into the channel, drawing the transfer rail toward its retracted position.

15. The system of claim 14 wherein the biasing means for urging the transfer rail toward its forward position comprises:

at least one transfer rail support rod having a first end mechanically connected to the transfer rail;

at least one support rod cylinder mechanically connected to a second end of the transfer rail support rod, each cylinder being compressible along the third, horizontal axis; and means for actuating each support rod cylinder so that, as the cylinder is actuated, the support rod and transfer rail move along the third, horizontal axis.

16. The system of claim 1 wherein the workpiece gripper is mechanically connected to a finger rail slidably mounted to the transfer rail and moveable along the first, longitudinal axis.

17. In a transfer system for moving workpieces along a first, longitudinal axis between a plurality of spaced apart workstations, the transfer system including a press having a ram moveable along a second, vertical axis, a bolster aligned with and positioned below the ram, and a transfer rail extending along the first, longitudinal axis, the transfer rail being supported for movement along the second, vertical axis between a raised and lowered position and along a third, horizontal axis, normal to the first, longitudinal axis, between a forward position and a retracted position, a finger rail slidably mounted to the transfer rail, the finger rail moveable along the first, longitudinal axis, the improvement comprising:

forward biasing means for urging the transfer rail toward its forward position and raised position, the forward biasing means comprising at least one transfer rail support rod having a first end mechanically connected to the transfer rail, at least one support rod cylinder mechanically connected to a second end of the transfer rail support rod, each cylinder being compressible along the third, horizontal axis, and means for actuating each support rod cylinder so that, as the cylinder is actuated, the support rod and transfer rail move along the third, horizontal axis;

lowering means for moving the transfer rail toward its lowered position, the lowering means comprising at least one upper cylinder, each upper cylinder being compressible along the second, vertical axis and mechanically connected to the ram, an upper plate, the upper cylinders disposed between the upper plate and the ram, at least one upper plate support cylinder, each upper plate support cylinder being compressible along the second, vertical axis and mechanically connected to the upper plate, a lower plate, the upper plate support cylinders disposed between the lower plate and the upper plate, support means extending between the lower plate and the transfer rail, such means being configured so that the lower plate and the transfer rail are each spaced apart from the ram by the same distance as the lower plate and transfer rail move along the second, vertical axis, and at least one lower plate support cylinder, each lower plate support cylinder being compressible along the second, vertical axis and mechanically connected to the lower plate, so that, as the ram moves linearly downward along the second, vertical axis, the ram compresses the cylinders, moving the upper plate, the lower plate and the transfer rail downward;

the upper cylinders, the upper plate support cylinders and the lower plate support cylinders being configured to bias the transfer rail toward its raised position; and retracting means for moving the transfer rail toward its retracted position comprising a channel, a flexible elongated strap having a first end attached to a stationary member and a second end attached to the transfer rail, the flexible elongated strap passing over the channel, and a projecting member attached to the ram and aligned with the channel so that the flexible strap is disposed between the channel and the projecting member so that, as the projecting member and ram move linearly downward, the projecting member contacts the flexible strap and moves the strap into the channel, drawing the transfer rail toward its retracted position.

* * * * *